US005398819A

United States Patent [19]

Cormack et al.

[11] Patent Number: 5,398,819

[45] Date of Patent: Mar. 21, 1995

[54] BLADE TENSIONING MECHANISM

[75] Inventors: Alexander D. Cormack, Marietta; Bengt A. Nilsson, Atlanta, both of Ga.

[73] Assignee: BMH Wood Technology, Inc., Doraville, Ga.

[21] Appl. No.: 181,388

[22] Filed: Jan. 13, 1994

[51] Int. Cl.[6] ..... B07B 1/49

[52] U.S. Cl. ..... 209/674; 209/394; 209/395

[58] Field of Search ..... 209/674, 675, 393–396, 209/404

[56] References Cited

U.S. PATENT DOCUMENTS

| | | | |
|---|---|---|---|
| 2,010,256 | 8/1935 | Cole | 209/395 X |
| 3,123,558 | 3/1964 | Sullivan | 209/393 X |
| 4,696,738 | 9/1987 | Risley | 209/674 X |
| 5,117,983 | 6/1992 | Marrs | 209/674 |
| 5,284,251 | 2/1994 | Marrs et al. | 209/396 |

FOREIGN PATENT DOCUMENTS

| | | | |
|---|---|---|---|
| 653630 | 5/1963 | Italy | 209/674 |
| 242912 | 1/1964 | Netherlands | 209/674 |

OTHER PUBLICATIONS

Strakes et al., "New Chip Thickness Screening System Boosts Efficiency, Extends Wear Life", *Pulp & Paper*, 6 unnumbered pages, Jul. 1992.

Technical Data SH Bushing, undated (1 page).

*Primary Examiner*—D. Glenn Dayoan

*Attorney, Agent, or Firm*—Needle & Rosenberg

[57] ABSTRACT

A tensioning member for a blade screen that permits simultaneous tensioning of a plurality of blades in a blade screen, such as for wood chip sorting, is shown. The blade screen tensioning member includes a hinged bracket that may be supported on a portion of a frame, a spring steel blade holder for engaging a press-snap inserted into a hole in each of the engaged blades, and an elastic stop nut and stud for tightening and tensioning the blades. The blades are held in place at the opposite end of the frame by a similar holder, which, however, is fixed rather than hinged. The spring steel blade holder is reinforced for additional strength, and is bent at an approximately 45 degree angle where the press-snap is engaged. The blades themselves may also be provided with a sawtooth detail on a bottom edge to reduce the build-up of wood ribbons or fines that would otherwise occur. A sliding bearing with a dovetail configuration is also provided. This sliding bearing allows a dual-frame blade screen to be assembled, while compensating for any phase angle error between eccenters provided to agitate the wood chips by moving the screens.

6 Claims, 10 Drawing Sheets

BLADE TENSIONING MECHANISM

FIELD OF THE INVENTION

This invention relates to a means for tensioning blades, and more particularly, to a means for tensioning blades in screen suitable for use in sorting wood chips by size, as is done in making pulp for paper production.

DESCRIPTION OF THE PRIOR ART

Wood fiber is the basic ingredient used in paper production. Although other types of fibers may also be used, more than half the fiber that is used in paper manufacture comes from trees that are cut specifically for the production of pulp. These trees are cut into logs that are reduced to pulp either by being mechanically ground into pulp or by being chipped and cooked in a chemical solution. The use of chemically digested wood chips generally results in a higher quality paper than does the use of mechanically ground pulp.

Two common processes are used to chemically reduce wood chips into pulp. The sulfite process, and the sulfate, or kraft, process. In both of these processes, lignin is dissolved under heat and pressure in a digester, resulting in the separation of cellulose fibers. Processing time may be as long as 12 hours, depending upon the size of the chips and the quality of the product desired. Processing chemicals, particles of undigested wood, and foreign materials are then removed, and the pulp is further processed into paper.

The amount of processing time required depends upon the thickness of the wood chips used. Thicker wood chips require a greater time for the processing chemicals to penetrate and dissolve their lignin, and thus would require a longer processing time to completely digest. Otherwise, the undigested part of the thicker chips would have to be mechanically treated, resulting in an inferior product, or removed from the pulp. Therefore, to ensure uniform processing time and paper quality, wood chips are sized before they are processed, with thicker wood chips being removed prior to pulping.

To sort wood chips, chips are dumped onto a screen having openings through which essentially only chips smaller than a preselected thickness may pass. The chips are then agitated, causing essentially all of the thinner chips to pass through the screen. The thicker chips may be sliced to the correct thickness or used in other ways or for other purposes, or discarded.

Several types of prior art screens are known. In one of these, shown in FIG. 1(*a*), pairs of spiral rolls 300 are used to separate wood chips of various sizes. In operation, wood chips are dumped onto the rotating spiral rolls, the rolls rotating in the directions indicated by arrows A and B. Chips are brought into the open area 302 between the rolls by this rotation, and chips thin enough to fall into the gap are collected for processing under the screen. Meanwhile, because of the spiral motion of the threads, thicker chips are brought forward as indicated by arrow C. Eventually, they reach the end of the gears, and at that point, may be collected or discarded. Typical dimensions of the rolls 300 are such that the open area between the rolls is only 7.9% of the total cross-sectional surface area, resulting in relatively low capacity.

A second type of prior art screen is shown in FIG. 1(*b*). This screen comprises an array of hubs 304 and disks 306 on parallel, spaced-apart shafts (not shown).

Because of the rotation of the shafts in directions indicated by arrows D and E, wood chips are brought into the region of intermeshed disks 307, where thinner chips fall through and are collected. Thicker chips remain on the screen, and must eventually be removed. The net open area for a typically dimensioned screen of this type is 20.9%. Therefore, this screen typically has greater capacity than that shown in FIG. 1(*a*), but still leaves substantial room for improvement.

A third type of screen is shown in FIG. 1(*c*). This screen is similar in operation to that shown in FIG. 1(*b*), except that the intermeshed hubs 304*a* and disks 306*a* vary in size along the lengths of the shafts. The typical net open area is 25.1%.

A fourth type of prior art screen is shown in FIG. 1(*d*). This screen comprises a series of elongate rectangular metal bars 308 arranged in parallel. An open area 310 of predetermined size separates adjacent ones of bars 308 to permit sufficiently thin wood chips to fall through for collection. The parallel, spaced-apart bars are held together by frame supports at each end. Agitation is provided by shaking the entire frame assembly. This type of screen typically provides the greatest percentage open area (37.1% –49.6%) of the prior art screens.

Because papermaking is a continuous process, the rate at which the thinner chips pass through the screen has proven in many circumstances to be a bottleneck limiting the rate at which paper can be produced in any given production line. Increasing the percentage open area would increase the capacity of the screen and therefore alleviate the effects of this bottleneck. Unfortunately, it is difficult to increase the percentage open area in prior art screens.

Referring to the screen of FIG. 1(*d*), the percent open area might be increased simply by using thinner bar stock. However, some wood chips, particularly wedge-shaped chips, tend to become lodged between the bars of this type of screen. It is therefore necessary to periodically stop the feeding of chips to prevent the screen from becoming clogged. This reduces the effective rate of wood chip sizing below that which would otherwise be expected from the larger effective screen open area percentages of this type of screen.

It would be possible to compensate for some of the lost capacity caused by stuck chips by further increasing the percentage of open space in the screen. Because the gap size is determined by the maximum acceptable wood chip thickness, the only way to increase the percentage of open space in the screen is to reduce the width of the bars in the screen. However, stuck chips generate pressures against the bars that tend to deform them unless the bars are of sufficiently heavy stock.

Screens comprising relatively thin, tensioned blades instead of bars are known, and such blades can comprise a screen with a substantial percentage of open space. However, one of the problems experienced with prior art tensioned blade screens is that the blades have had to be individually tensioned to provide the required stiffness required in screen separators. It was further necessary to retension the blades as each blade was progressively tightened, which resulted in frame deflection and a further retensioning. It would therefore be desirable to provide a screen tensioning mechanism that can simultaneously tension a large number of blades at a time.

Prior art blade screens also have a tenancy to generate a build-up of wood ribbons or fines between the slots and particularly around the frames supporting the blades. These ribbons or fines can interfere with the efficient operation of the screen. It is thus desirable to provide a means to prevent the build-up of such waste material.

Finally, in dual-frame screens, in which alternate blades are supported on different frames (one inside the other), it is necessary to provide a means for moving the frames relative to one another to impart sufficient agitation to the wood chips to ensure efficient separation. This motion can be imparted by moving the frames in a reciprocating motion relative to one another. Support near four corners has typically been provided, with agitation provided by an eccenter journal. Without precision machining of frames, cams, and journals, binding can result. It would therefore be desirable to provide a joint for transferring motion from an eccenter journal to a corner of a frame that can accommodate slight tolerance variations.

BRIEF DESCRIPTION OF THE INVENTION

The present invention provides a tensioning mechanism for a blade screen comprising a blade holder made from spring steel or other suitably stiff, springy material clamped in a bracket. The bracket is hinged and accurately located on the machine frame where it is both fastened and dowelled. A blade assembly is tightened with an elastic stop nut on a stud with the position of the load maintained via a set of spherical washers.

The elastic stop nut and stud also permit simple installation and removal of blades. By predetermining the torque required to achieve the desired blade tension, the blades can be quickly set to the specified tension.

A spring-type blade holder accommodates slight variations in the pin-to-pin center distance between the blades. It also accommodates minor deflections of the frames of the blade screen, which otherwise may cause the blades to require retensioning as they become loose due to deflection of the frames.

The blade holder allows typically, fifteen blades to be tensioned at the same time, although a greater or lesser number may also be accommodated. Previously, it was necessary to tension each blade individually. Further, retensioning was required as the blades were progressively tightened, which resulted in frame deflection and the requirement of further retensioning. The blade holder is provided with a series of parallel slots, which are preferably cut with a laser to ensure maximum accuracy, and to allow inner and outer blade assemblies to be interleaved.

In addition, the blades may be provided with a sawtooth detail to ensure that ribbons or wood fines are prevented from building up in the slots between the blades to the point at which they begin to interfere with the normal movement of the blades.

Blade holders can be changed without concern as their assembled accuracy can readily be assured by sufficiently accurate machining and by the use of locating dowels.

The blade assembly tensioning means comprises an elastic stop nut on a stud. The direction of the imposed load is preferably maintained by a set of spherical washers. The blades themselves are preferably provided with a sawtooth detail on the bottom surface. This surface is the most likely region in which a blade might encounter a build-up of ribbon-like material. Tests have shown that the region most subject to such a build-up is in the vicinity of the blade holders at the discharge end of the screen, with the most pronounced build-up being on the outer frame. The sawtooth detail on the blades, together with the straight spring bent towards the discharge, effectively eliminates the build-up of these ribbons.

In addition, a coupling for a frame and an eccenter journal is provided. The coupling comprises a pair of female dovetail segments attached to opposite vertical sides of a frame member, a slide plate affixed to the bottom side of the frame member, and a male dovetail segment affixed to the top of an eccenter journal. Small tolerance variations that would otherwise bind the movement of the frames can be accommodated in the coupling of the female and male dovetail segments and the movement of the slide plate over the face of the dovetail segment.

It is thus an object of the invention to provide a blade tensioning means that can effectively allow a plurality of blades to be tensioned simultaneously. It is a further object of the invention to provide a blade that reduces the accumulation of wood fires, especially in the vicinity of the blade holder and guides. It is a still further object of the invention to provide a siding bearing mechanism that prevents binding in a dual eccentric shaft assembly. These and other objects will become apparent to one skilled in the art upon reading the detailed description.

BRIEF DESCRIPTION OF THE DRAWINGS

FIG. 1(*a*) shows a screen comprising worm gears. FIG. 1(*b*) shows a screen comprising an array of hubs and shafts. FIG. 1(*c*) shows a screen comprising a modified array of hubs and shafts. FIG. 1(*d*) shows a screen comprising a plurality of bars.

DETAILED DESCRIPTION OF AN EMBODIMENT OF THE INVENTION

Figure 1A:
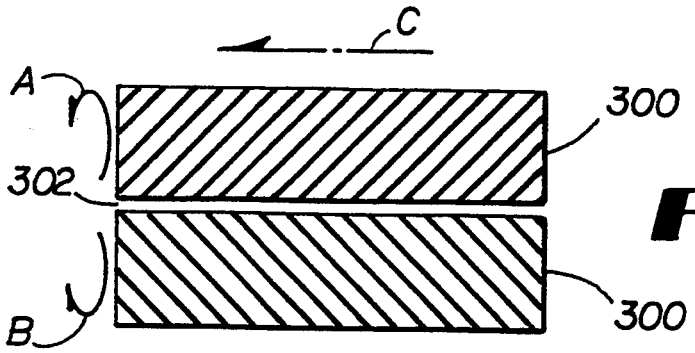
FIG 1A PRIOR ART
FIGS. 1(*a*)–(*d*) are schematic views of the top of various prior art screens.
Figure 1B:
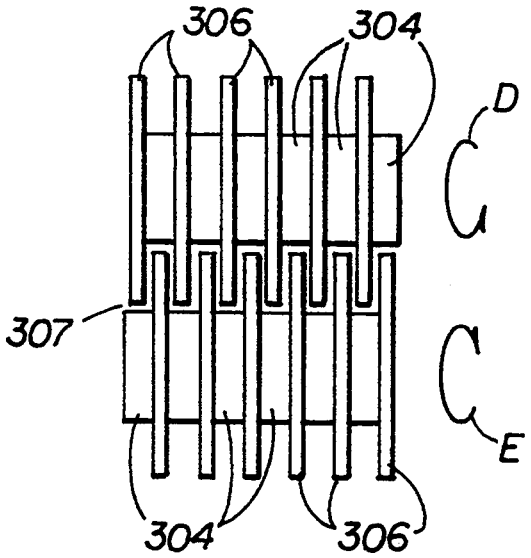
FIG 1B PRIOR ART
Figure 1C:
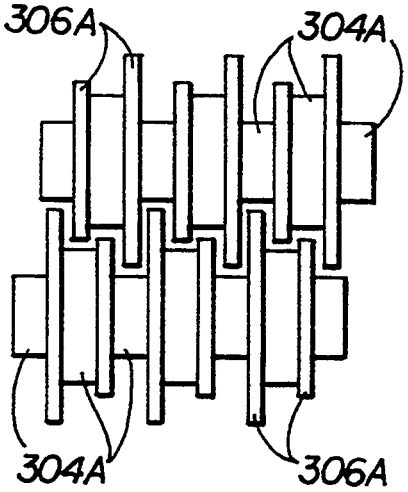
FIG 1C PRIOR ART
Figure 1D:
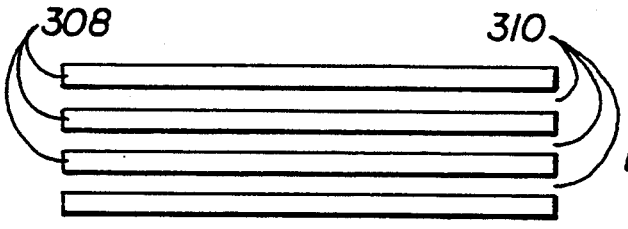
FIG 1D PRIOR ART
Figure 2:
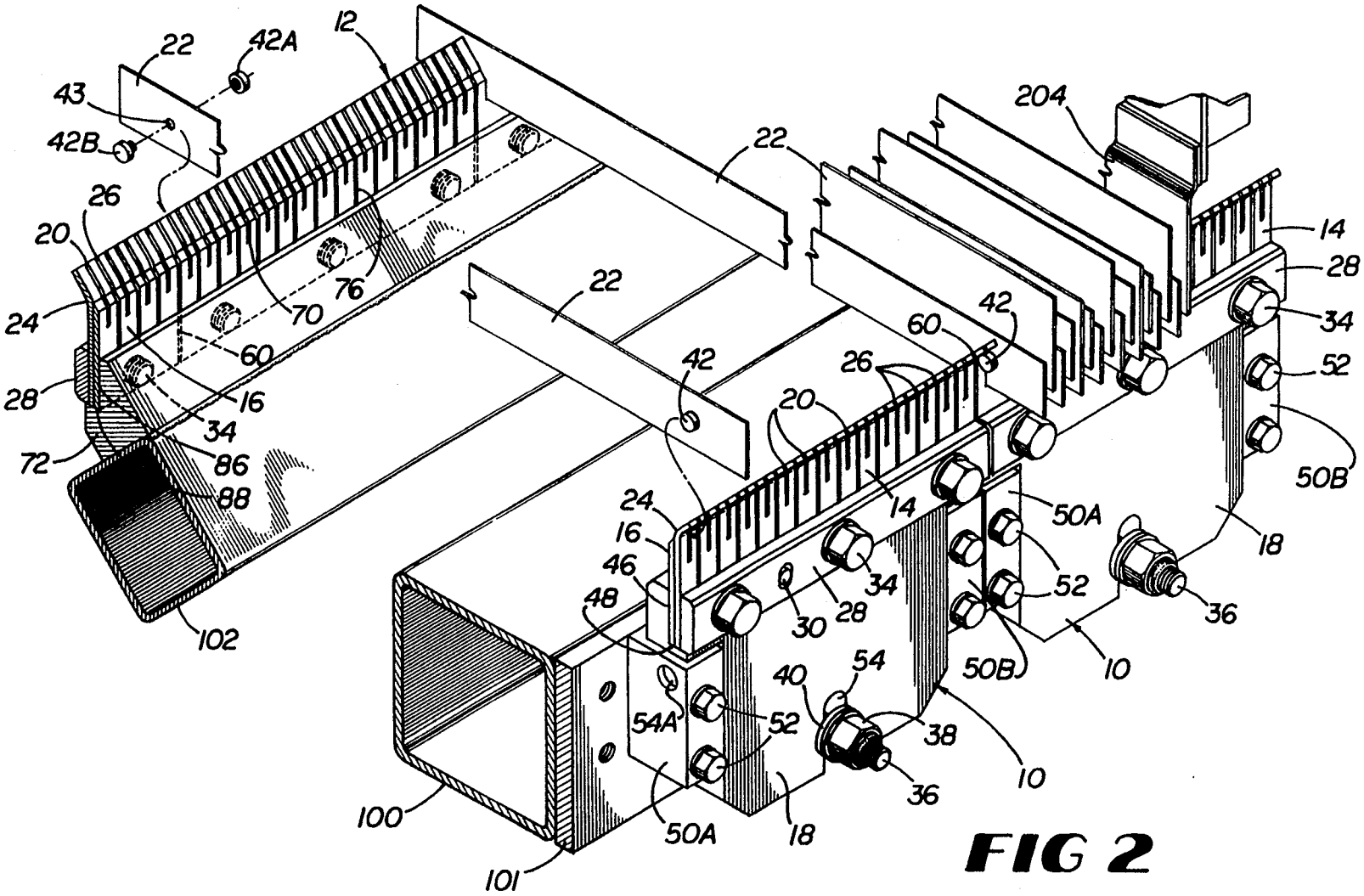
FIG. 2 is a perspective view of a portion of a blade screen tensioner, showing the relationships between the blades and one of the frames comprising the screen.

Turning now to FIG. 2, a view of an embodiment of the inventive tensioning device 10, 12 for a blade screen is shown. The front assembly 10 of the tensioning device comprises a steel spring blade holder 14, a reinforcing comb 16, and a bracket 18. (It is to be understood that other suitably stiff and springy materials may be substituted for steel in blade holder 14.) Blade holder 14 and reinforcing comb 16 are fixedly attached to bracket 18 by any suitable means. In the illustrated embodiment, a clamp 28 presses both blade holder 14 and reinforcing comb 16 against a recessed face 46 of bracket 18. The flat, straight bottom edges of blade holder 14 and reinforcing comb 16 may be fixed against a bottom wall 48 of the recessed region. Bolts 34 are threaded into clamp 28, blade holder 14, reinforcing comb 16, and recessed face 46 to hold blade holder 14 and reinforcing comb 16 in place. An alignment pin 30 may be provided to align the blade holder 14 and reinforcing comb 16.

Blade holder 14 is provided with a series of spaced-apart vertical slots 20 alternating with longer, spaced-apart vertical slots 26. For accuracy, these slots are preferably cut by lasers. Preferably, neither slots 20 nor slots 26 extend into the clamped region between recessed face 46 and clamp 28. This permits each section of blade holder 14 and reinforcing comb 16 to be handled and secured as a unit, even though both may tension a plurality of blades 22. Slots 26 preferably do, however, extend essentially up to the clamped region, thereby allowing blade holder 14 to act as a series of simultaneously positioned, but independently deformable tines around each of shorter slots 20. Slots 20 are dimensioned to allow separate blades 22 to be placed therein. Reinforcing comb 16 also has a similar series of vertical slots of alternating length (70, 76, not shown in conjunction with front portion 10, but better seen at rear portion 12 of the tensioning device), which are aligned with and are essentially same length as slots 20 and 26 in blade holder 14.

Slots 20 are dimensioned to hold blades 22 therein and to permit tensioning by the tensioning device 10 in a manner to be explained below. Vertical slots 26 are dimensioned to allow blades tensioned on different frame to pass therethrough, and to permit relative movement between the two frames. If more than one bracket 18 is provided, the brackets 18 should be positioned so that a space 60 equivalent to a slot 26 may be provided between the blade holders 14 and reinforcing combs 16 affixed to adjacent brackets 18.

Bracket 18 itself is held in place between a pair of hinge sections 50*a*, 50*b*, which may be stationarily affixed to a frame member 100 (or an optional attachment plate 101 affixed to the frame member) by any suitable means, such as by bolts 52. A dowel 54A is provided through a hole in the hinge sections 50*a*, 50*b*, to allow bracket 18 to pivot about the dowel's axis. Bracket 18 has a slot 54 to accommodate a stud 36 affixed to front frame member 100 (or attachment plate 101). An elastic stop nut 38 on stud 36, is provided to hold bracket 18 in place against the tension of a plurality of blades 22, preferably in conjunction with spherical washers 40.

Rear frame member 102 (which is the rear of the frame comprising front frame member 100) has a separate, fixed rear tensioning assembly 12. Rear tensioning assembly 12 comprises a fixed rear mounting bracket 72 affixed to rear frame member 102 by a suitable means, such as by welding. Rear mounting bracket 72 preferably has surfaces 86, 88, corresponding to recessed face 46 and wall 48, respectively, of front bracket 10 for mounting blade holders 14 and reinforcing combs 16 thereto, using brackets 28 and bolts 34. Of course, any other suitable mounting means may be employed for mounting the blade holders 14 and reinforcing combs 16, provided that the blade holders 14 and reinforcing combs 16 on the front assembly 10 and rear assembly 12 are suitably aligned, so that each blade 22 may be inserted into corresponding short slots 20, and interleaved blades affixed to another screen (not shown) may engage slots 26. The blade holders 14 and reinforcing combs 16 of the rear assembly 12 may be identical to those in front assembly 10; if a plurality of holders 14 and combs 16 are used, they should be separated so as to form a slot 60 equivalent to longer slots 76 and 76.

Blades 22 are provided with (preferably elastic) press-fit snaps 42 or other suitable engagement means to engage blade holders 14 in both the front and rear assemblies 10, 12. A press-fit snap comprising two sections 42*a*, 42*b* is shown at the rear of blade 22 in FIG. 2. The snap 42 fits through a hole 43 in the blade. Hole 43 is positioned so that the blade 22 may rest at the bottom of a short slot 20, while the snap 42 engages blade holder 14 in a short slot 20 at bend 24. Bend 24 is preferably at an approximately 45 degree angle to prevent the snap 42 from riding up the slot 20 or deforming the blade holder 14 around slot 20. The bends 24 of the front and rear tensioning assemblies 10, 12 are directed in opposite directions, away from one another, so that, motions tending to cause a blade 22 to migrate upward cause the spring blade holder 14 to redirect the blade downward into its respective slot 20.

Figure 3:
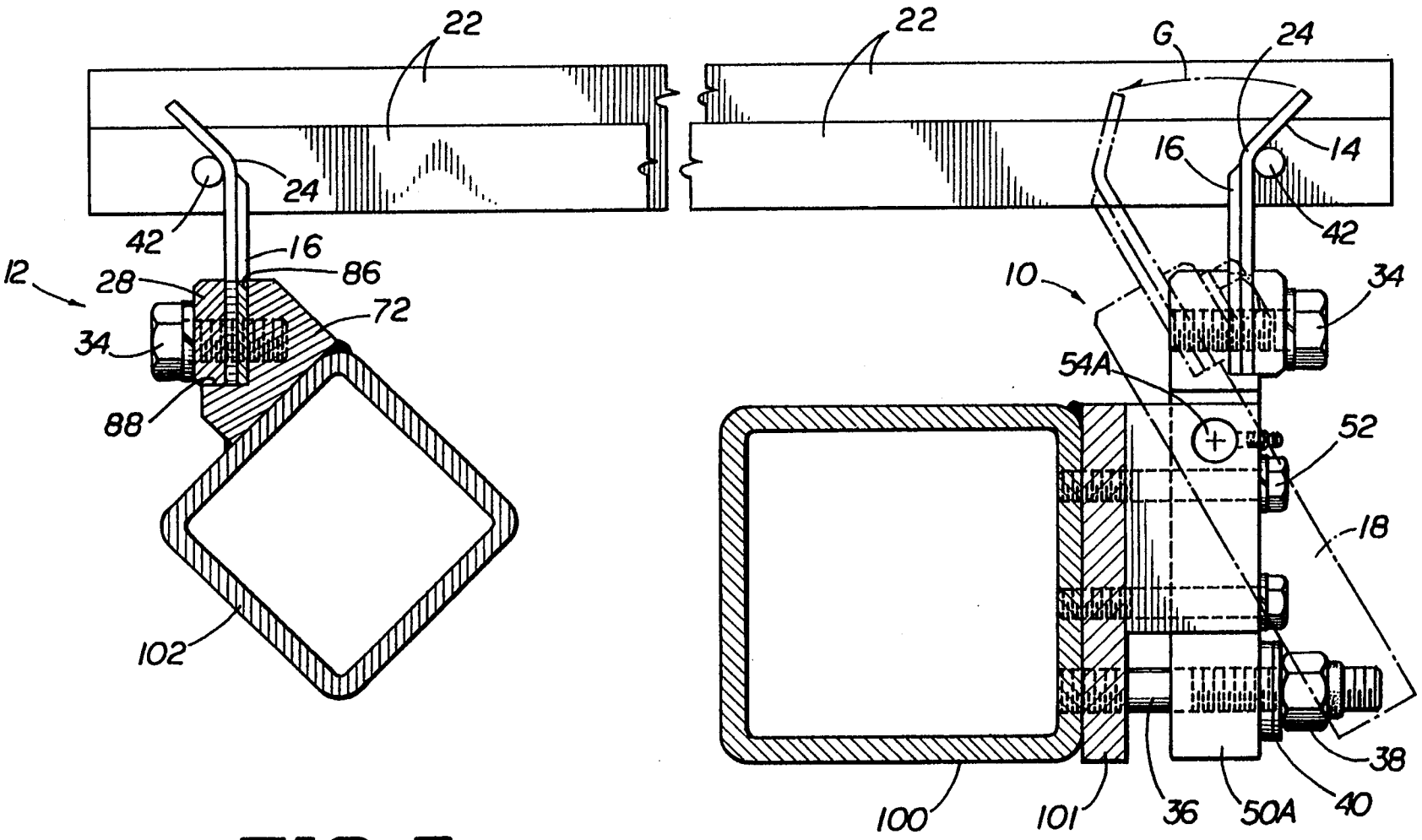
FIGS. 3 is a side view of a portion of a blade screen tensioner in accordance with the invention, showing the operation of the tensioning mechanism.

Turning now to FIG. 3, a side view of the tensioning device is illustrated. Because slots 20 are aligned between the front and the rear tensioning assemblies 10, 12, blades 22 (which show blades of alternating height) may be inserted into position by pivoting bracket 18 into its open position as indicated by the phantom lines and arrow G. Bracket 18 is then returned to its closed position, and elastic stop nut 38 is tightened on bolt 36. This tightening causes the spring blade holders 14 on front and rear tensioning assemblies 10, 12 to pull on snaps 42, tensioning blades 22. Stop nut 38 may be tightened until the desired tension is obtained.

Spring blade holder 14 is able to accommodate slight tolerance variations on each of blades 22 tensioned within slots 20, partly because of the relatively independent spring action around each slot 20 (Each slot 20 is surrounded by either an edge of the blade holder 14 or a long slot 26 on each side. Thus, each slot 20 behaves as though it were formed in an independent spring.), and partly because of the elasticity of the snaps 42. In addition, the slightly curved inner surface of blade holder 14 at bend 24 allows the snap to position itself appropriately against the blade holder, automatically compensating for slight tolerance variations. It has been found highly advantageous to provide reinforcing comb 16 to provide stiffness to the straight section of blade holder 14 below bend 24, while allowing blade holder to provide greater spring action bend 24. Reinforcing comb 16 thus has height only sufficient to reach approximately to bend 24, and is preferably beveled at its top. Thus, reinforcing comb 16 transmits a substantial fraction of the tension provided by tensioning assemblies 10 and 12 to blades 22, while the spring action of blade holder 14 above bend 24 is largely responsible (together with the elasticity of snaps 42) for accommodating variations in tolerances, such as those between blades (including, for example, the heights of holes 43, the dimensions of snaps 42, the distance between holes 43 on a blade), or other tolerance variations having a similar effect.

Fixed fences 204 (only one of which is shown) are also provided at each side of the screen to prevent wood chips from exiting the sides of the screen comprising a plurality of blades 22, rather than going through it. Fixed fences 204, which extend the entire length of the screen, and which may be supported by attachment to a portion of the separator structure (not shown) each engage slots 20, 26 in a manner analogous to a blade 22, although they need not be secured to the blade holders 14, since they are secured to the separator structure.

Figure 4:
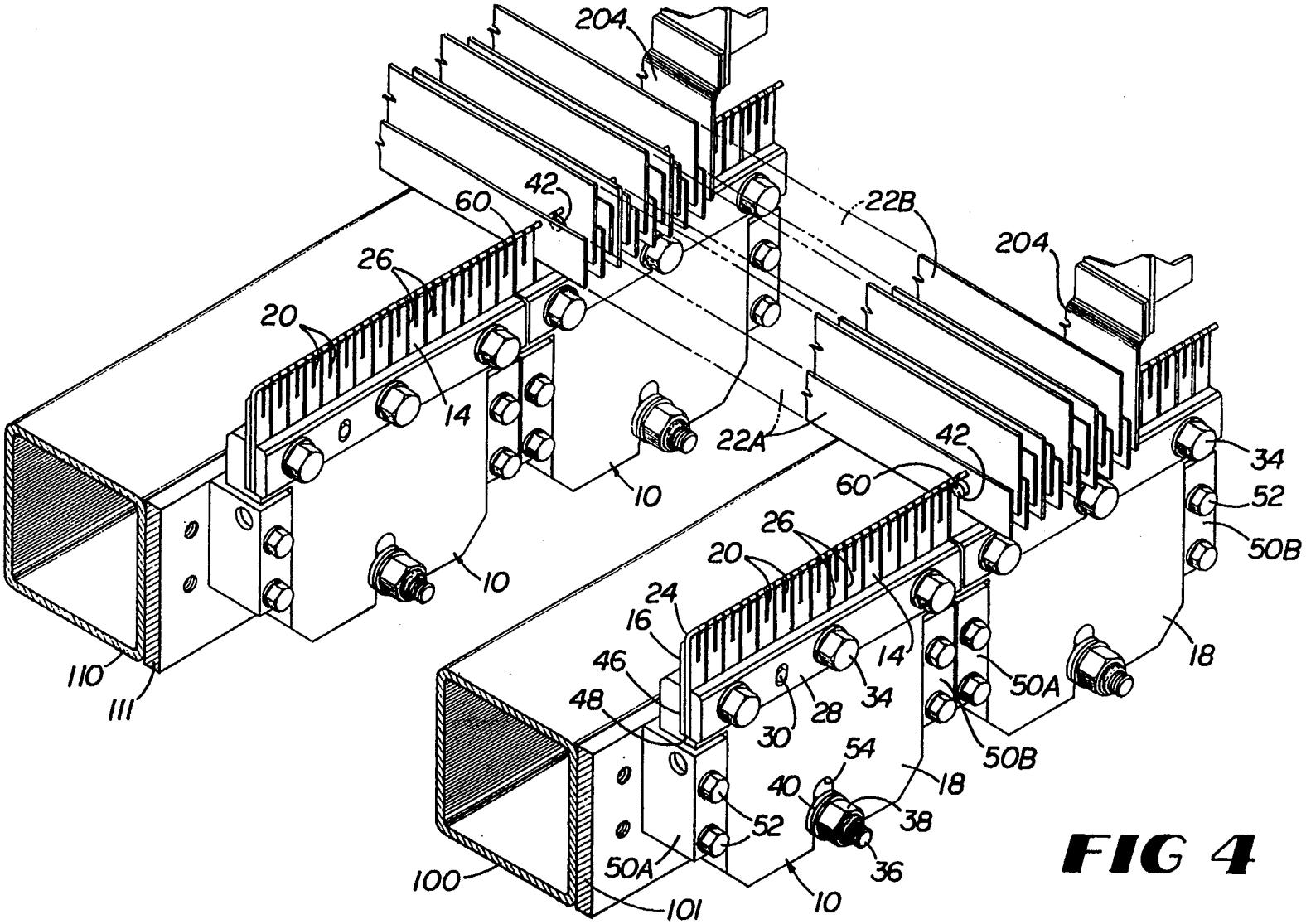
FIG. 4 is another perspective view of a portion of a blade screen tensioner, showing the inner and outer frames of the screen and their relationship to one another and to the blades themselves.

Referring to to FIG. 4, a view of the front members 100, 110 of an outer and an inner frame, respectively, is shown. Front frame members 100, 110 are shown with optional attachment plates 101, 111, respectively, affixed thereto. Alternating blades 22A, 22B have snaps 42 disposed at different positions along their length, so blades 22A may be held in place by tensioning assemblies 10 on the inside front frame member 110, and blades 22B may be held in place on the outside front frame member 100. (The snaps 42 at the rear are similarly disposed differently between alternating blades, so that a blade held in place by a front tensioning assembly 10 on either an inner or outer frame is held in place by a rear tensioning assembly 12 disposed on a rear member of the same frame—either the inner frame or the outer frame. It is, of course, to be understood that blades 22A and 22B shown in FIG. 4 are each representative of one-half of a set of interleaved blades forming a screen.) Each of blades 22A and 22B are, however, at least long enough so that all of the blades extend across the entire length of the outer frame assembly. The slots 20, 26 in front tensioning assemblies 10 are aligned so that a blade 22A engaged in a short slot 20 in a tensioning assembly 10 on inner front frame member 110 passes through a long slot 26 (or an equivalent slot 60 between two tensioning assemblies) in a tensioning assembly 10 on outer front frame member 100. Similarly, a blade 22B engaged in a short slot 20 in a tensioning assembly 10 on outer front frame member 100 passes through a long slot 26 (or an equivalent slot 60 between two tensioning assemblies) in a tensioning assembly 10 on inner front frame member 110. Because the flat faces of each blade 22A, 22B are in a vertical plane, and because long slots 26 are vertically disposed, the inner and outer frames may move slightly relative to one another in directions X, Y, parallel with the flat faces of interleaved blades 22A and 22B, to agitate wood chips placed on a screen comprising the interleaved blades.

Each front and rear tensioning assembly 10, 12 provides space for fifteen blades 22. Although fifteen blades is considered a practical number to tension together, the tensioning assemblies 10, 12 may easily be modified to tension a greater or lesser number of blades. Although a tensioning assembly for a greater number of blades may reduce the amount of work required to tension an entire screen, tensioning too many blades at once may prove impractical. The amount of torque needed to adequately tighten nut 38 (which may vary with the size and composition of blades 22 in the screen) must be taken into consideration. If the torque required is excessive, tensioning may prove too difficult.

Figure 5A:
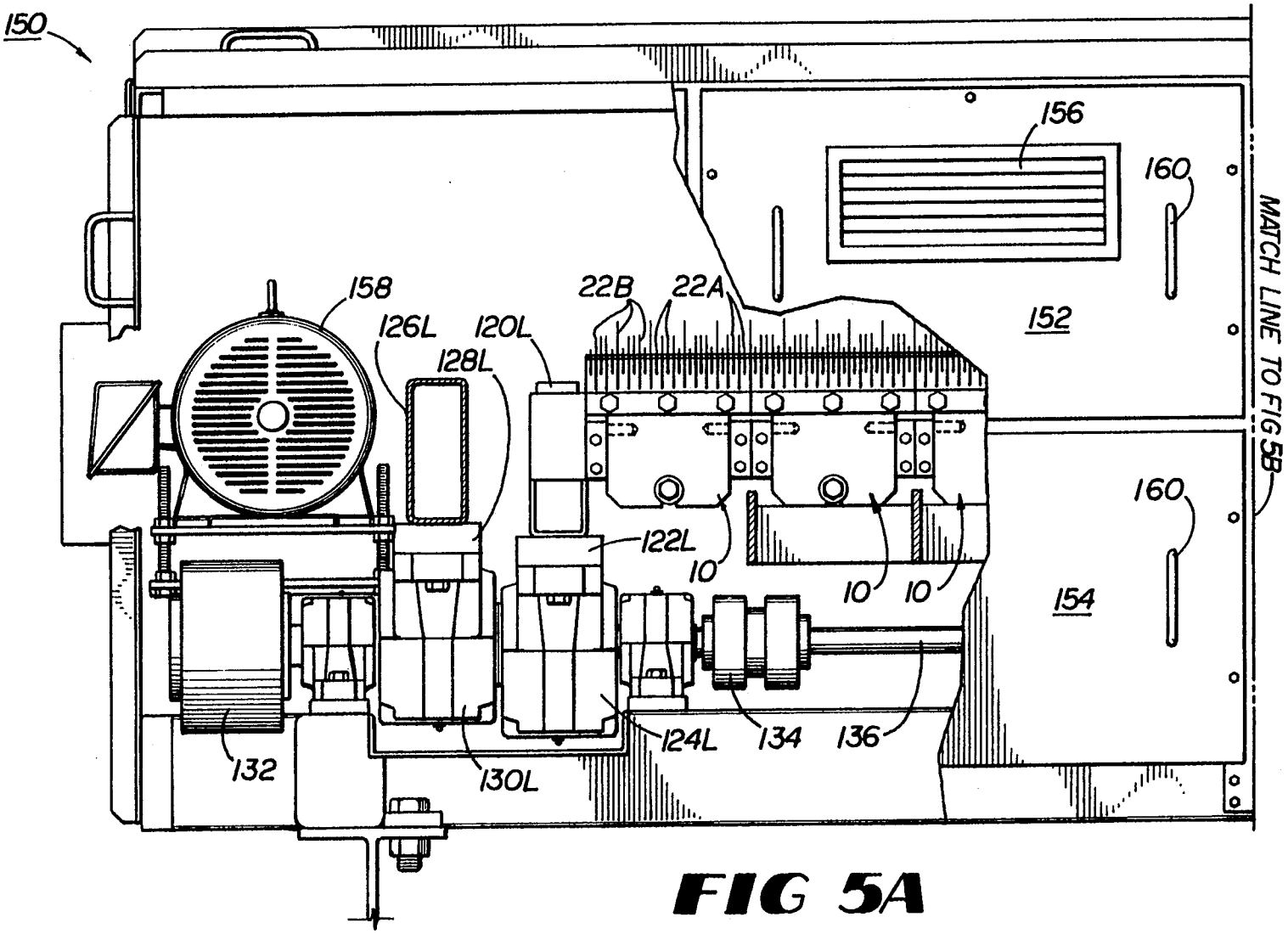
FIGS. 5(*a*) and 5(*b*) are cut-away front views of different sections of a blade screen separator having a blade screen tensioner in accordance with the invention.
Figure 5B:
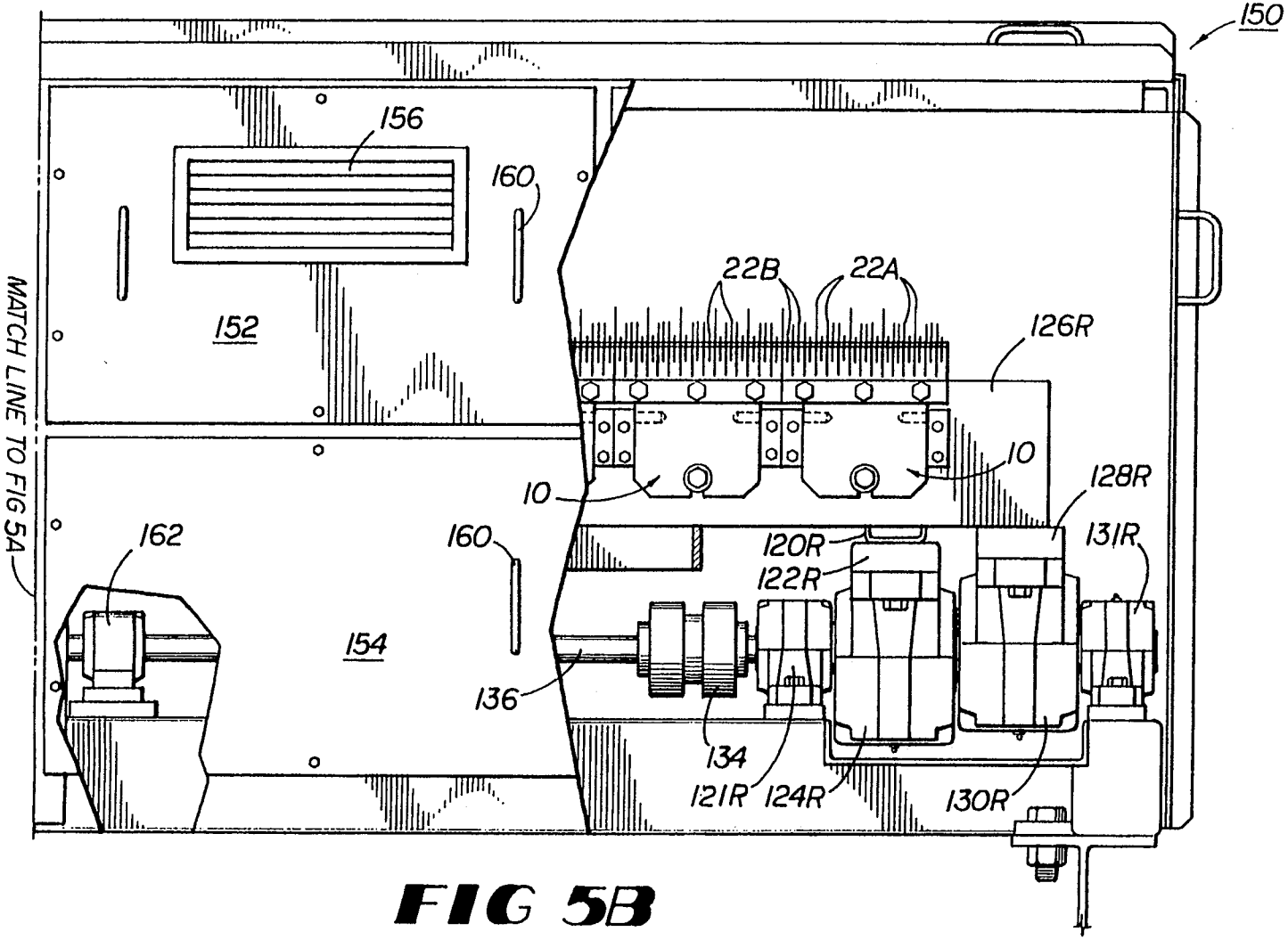
Figure 6A:
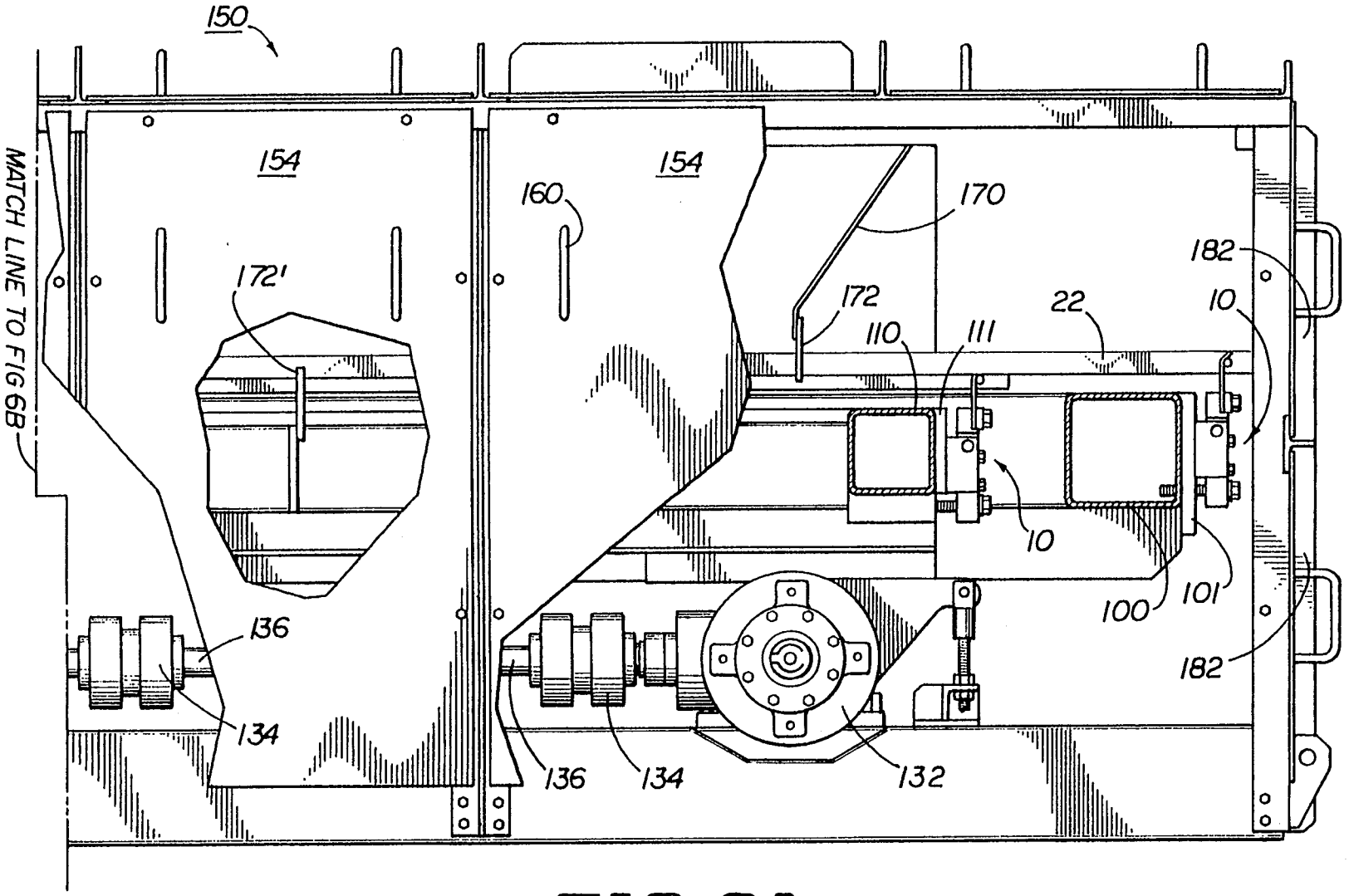
FIGS. 6(*a*) and 6(*b*) are cut-away side views of different sections of the blade screen separator of FIGS. 1(*a*) and (*b*).
Figure 6B:
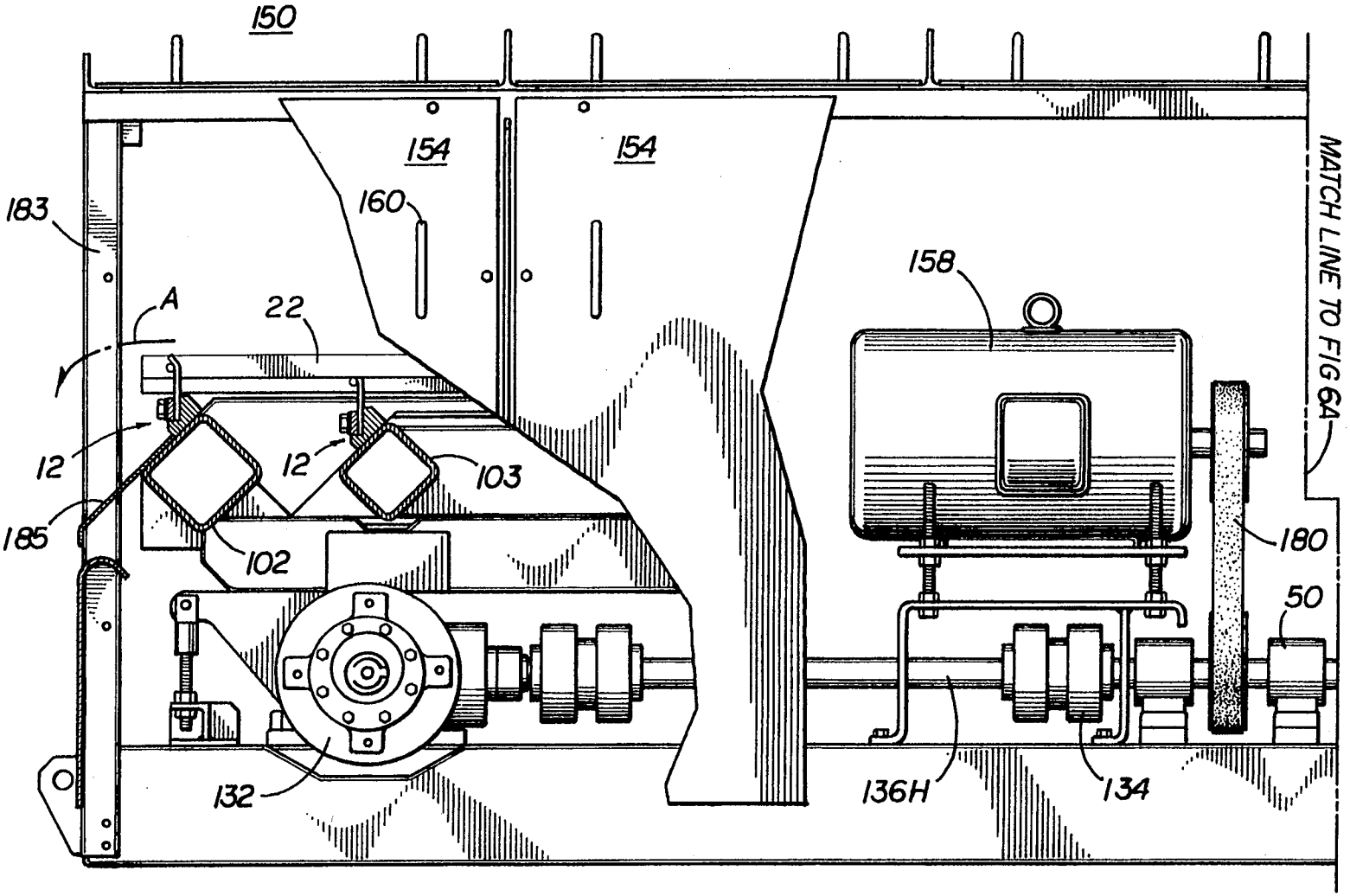

Referring now to FIGS. 5(*a*) and 5(*b*), which together form a staggered, cut-away front view, and also FIGS. 6(*a*) and 6(*b*), which together form a staggered, cut-away side view, a wood chip separator 150 incorporating the inventive blade screen assembly is shown. For clarity of illustration, and to provide a more detailed view of the invention and its relationship to the other components in the separator, the drawing of the front view of the separator has been divided into two sections, FIGS. 5(*a*) and 5(*b*), that are to be joined along the indicated match line. The side view has similarly been divided into two sections, FIGS. 6(*a*) and 6(*b*), which are also to joined along an indicated match line. The wood chip separator 150 is enclosed on all sides by a combination of vented panels 152 and unvented panels 154. Vents 156 provide air circulation for the electric motor 158 inside. The vented and unvented panels 152, 154 may be removed with the aid of handles 160 to access the internal parts of separator 8.

FIG. 5(*a*) shows a embodiments of the front assembly 10 of the tensioning device on an inner frame member (not visible in FIG. 5(*a*)). Interleaved blades 22A and 22B, previously described in conjunction with FIG. 4, are shown in relationship to one another in this end-on view. Journal 162 for shaft 136 is also shown in FIG. 5B. Right side components are identified by an "R" suffix for the reference numerals, while left side components are identified with an "L" suffix. Side member 120L of the inner frame is mechanically coupled to an eccentric journal 122L, which is part of a conventional crankshaft and bearing assembly 124L. Side member 126L of the outer frame is mechanically coupled to another eccentric journal 128L, which is part of another conventional crankshaft and bearing assembly 130L. Crankshaft and bearing assemblies 124L, 130L are coupled to a shaft 136, which may actually comprise a number of sections joined by one or more flex couplings 134L. The shafts are rotated by electric motor 158, through additional shafts 136L and couplings 134L, and right angle reducer 132. A similar arrangement on the right side of the frame is shown in FIG. 5B, where the cut-away section is arranged to show the tensioning assemblies 10 disposed on the outer frame. The eccentric journals 122L, 128L, 122R, and 128R, together with other similar assemblies at the rear of the inner and outer frames, impart a coordinated, complementary reciprocating motion to the inner and outer frames in a plane parallel to the flat surfaces of blades 22A and 22B when motor 158 is energized. This motion agitates wood chips placed on top of the screen formed by the various blades 22A, 22B.

Electric motor 158, better shown in FIG. 6(*b*), is coupled by belt 180 to a high speed shaft 136H. Flex couplings 134 are provided in high speed shaft 136H to simplify servicing of shaft 24. Conventional right angle reducers 132 couple the motion of shaft 136H to the low speed shafts 136 in the front and rear of chip sorter 150. The low speed shaft 136 in the front of the chip sorter 150 is shown in FIGS. 5(*a*) and 5(*b*), and is coupled to the eccentric journals 122L, 122R, 128L, 128R. Additional coordinated eccentric cranks (not shown) are provided in corresponding positions at the rear of chip sorter 150 for the same purpose. Power is supplied to the cranks at the rear of chip sorter 150 by means of a shaft (not shown) at the rear of the sorter coupled to a right angle reducer 132.

In operation, wood chips are fed from a wood chipper (not shown) into chip sorter 150 from the top at a point some distance inward from the front panels. A chute or baffle 170 is preferably provided for this purpose and to prevent wood chips from impinging on the front panels 182 or from falling off the edge of the screen near the front panels 182. The end of baffle 170 is provided with a spacer comb 172, the sides of which are mounted to inner frame members; thus, baffle 170 moves relative to the outer frame. The spacer comb 172 permits the blades 22 (one of which is shown lengthwise in FIG. 6(*a*)) to reciprocate within its slots, while preventing stray chips from working their way towards the front of the chip sorter near front panels 182. An additional spacer comb 172' can be provided near the center of the screen. The reciprocating motion of one set of blades 22A relative to the other set 22B encourages smaller wood chips to fall between the blades into a collector (not shown). Larger wood chips do not fall through and are essentially shaken out towards the rear 183 of separator 150, where an outflow of "overs" occurs as indicated by arrow A. A baffle 185 is preferably provided to guide this flow out of the open rear end of the sorter. The overs may be reprocessed into smaller chips, discarded, or used for other purposes. Spacer comb 172' assists in preventing blades 22 (comprising blades 22A and 22B) from being bent out of shape, thereby distorting the blade gap, should chips having odd shapes and sizes (particularly wedge-shaped chips) become caught between blades 22. Thus, clogging or ruining of the screen is effectively prevented and the quality and efficiency of chip thickness is assured. The portions of the inner frame 103 and outer frame 102 nearest the rear 183 of the chip sorter 150 preferably do not present horizontal surfaces at their top. Such a horizontal surface might tend to accumulate chips on its top and thereby impede the outflow of overs, thus slowing the sorting process.

As noted above, blades 22 are preferably made of sawblade material. To ensure that the proper tension can be provided on the blades 22, and also to ensure that they do not deform too easily if odd-shaped (particularly wedge-shaped) wood chips become stuck between them, the minimum thickness of the sawblade material should be 1.5 millimeters. The blades should also be thin enough to permit them to be tensioned, as shown below, without excessive torque being required. Otherwise, the maximum thickness is readily determined by the percentage of open space desired in the screen and the desired spacing between adjacent ones of the blades 22 (i.e., blades 22A and blades 22B), the spacing, of course, being determined by the wood chip size requirement.

Figure 7:
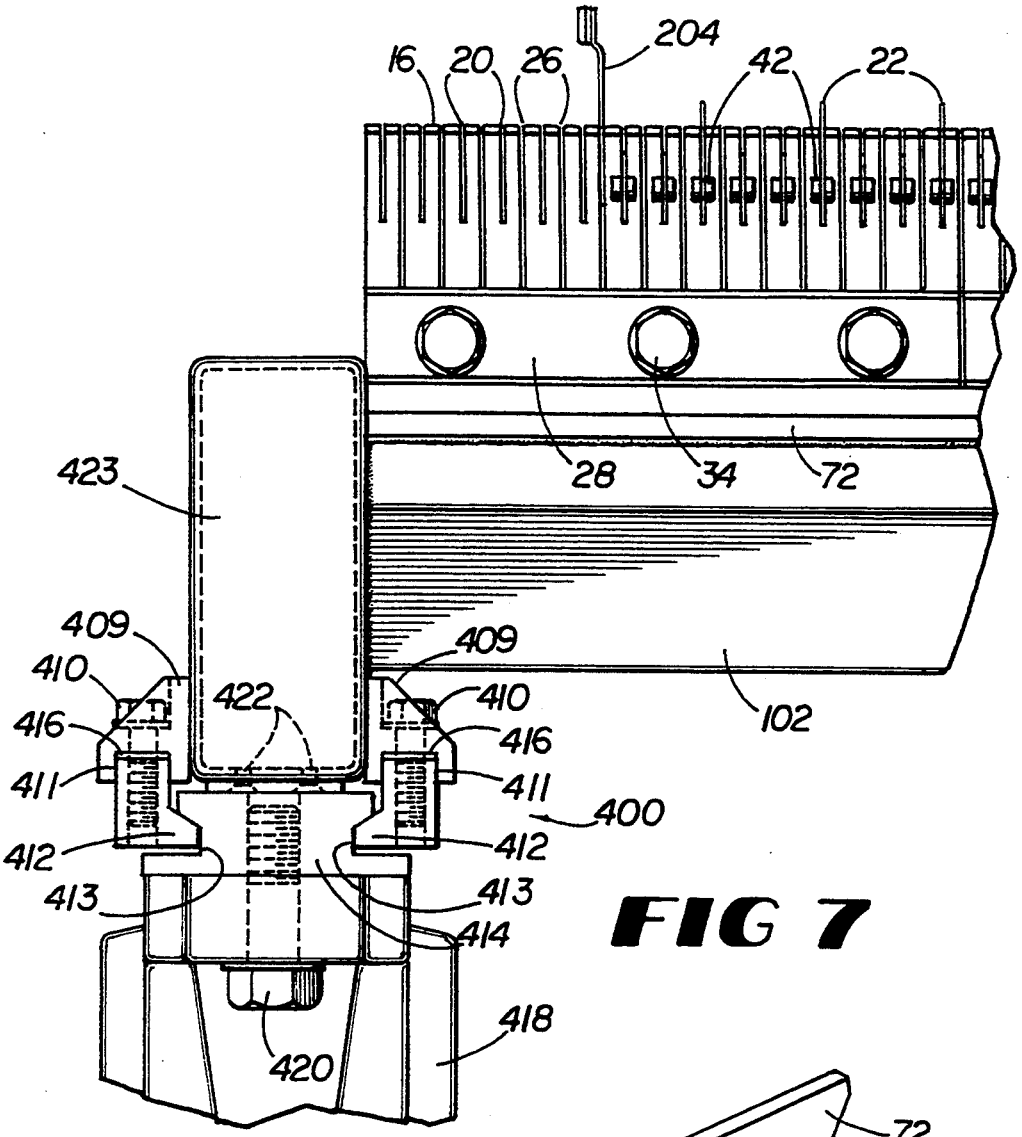
FIG. 7 is an end view of the mounting of one of the cross beams of the frame on a longitudinal beam, showing how an eccentric journal mount may be used to move the screen blades to agitate the wood chips.
Figure 8:
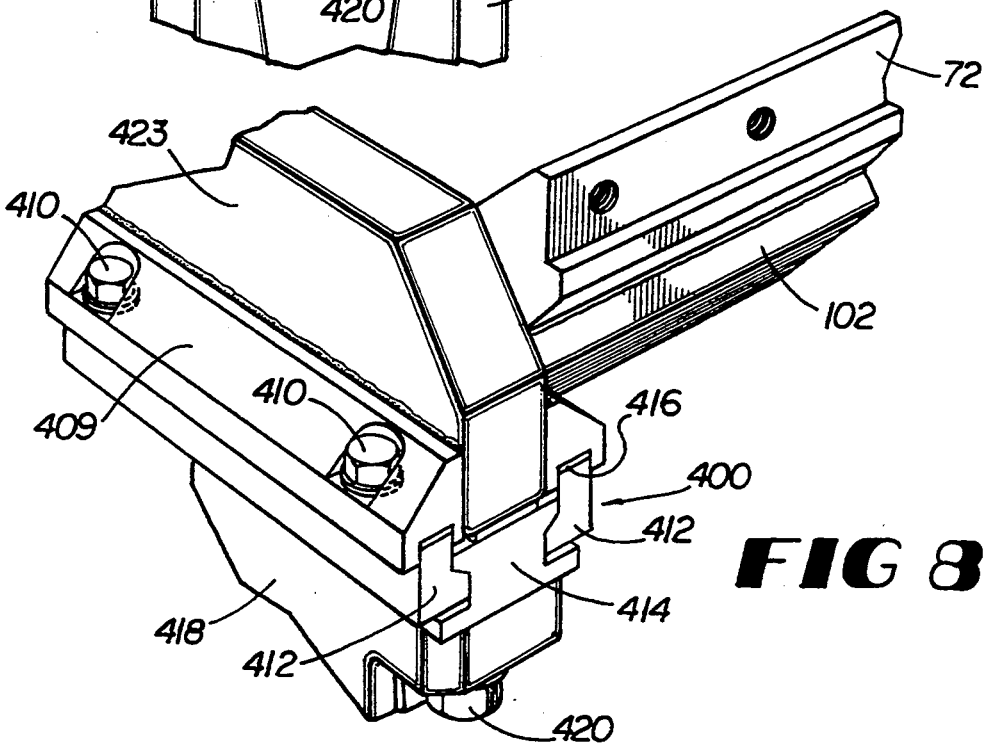
FIG. 8 is a perspective view of the mounting shown in FIG. 6.

FIGS. 7 and 8 are rear views, with FIG. 8 in perspective, of how the eccentric shafts adjacent the ends of the rear frame members 102 and 103 are coupled to their respective frames. To allow the inner and outer frames to move properly, additional eccentric shafts, such as shaft 418 shown in FIGS. 7 and 8, are required at the rear of the frames. The movement of these additional eccentric shafts must be properly coordinated with the movement of eccentric shafts at the front of the frames, or else the moving mechanism would bind, wear, or destroy itself. To account for, e.g., discrepancies in the length of the frames, each rear eccenter shaft such as shaft 418 is provided with means 400 in accordance with another aspect of the invention, and as illustrated in FIGS. 7 and 8, to permit sliding engagement of the frame with the shaft and to reduce the criticality of the frame dimensions. The preferred sliding engagement means comprises a pair of wing members 409 on each elongate side of its respective side frame member (e.g., side frame or longitudinal member 423) which is fixedly and stationarily attached to its respective rear frame member (preferably by welding to, in this case, rear frame member 102). Wing members 409 are preferably attached to their respective side frame members by welding. Each wing member 409 engages a male dovetail segment 412 using suitable attachment means such as bolt 410 and shim pack 416. Eccentric journal 418 is provided with a male dovetail segment 414, which may either be stationarily attached to or integral to journal 418; FIGS. 7 and 8 show, for example, male dovetail segment 414 attached to journal 418 with a bolt 420 at the rear of the eccenter 418; an additional bolt (not shown) may be required in this case at the front of the eccenter 418. Female dovetails 412 are engaged in respective notches 413 of mail dovetail segment 414. Notches 413 are slightly larger than necessary to tightly engage female dovetails 412 so that tolerance variations may be accommodated. A (preferably bronze) slide plate 420 between the top of male dovetail segment 414 and the bottom of side frame member 423 is provided to allow some motion between these two surfaces; a minute gap (not shown) is preferably provided to allow sliding between the surfaces. Slide plate 420 may be stationarily attached to side frame member 423 by bolts 422.

The sliding engagement means 400 permits the screen to function, without binding. The arrangement compensates for relative phase angle error between eccenter journals at the corners of the frame (including journal 418) by allowing the inner and outer frames to have a controlled movement as exhibited by a relative movement between the male portion 414 of the dovetail mounted to the pillow block on eccenter journal 418 and the female sections 412 mounted to the frame section 423. The clearance between the two dovetail portions 414 and 412 is adjustable by means of shim pack 416, which is clamped between the female dovetail segments 412 and the wing members 409 attached to frame section 423. Although phase angle error can be adjusted within limits with using an SKF Industries (King of Prussia, Pa.) SH type bushing in the couplings on the main drive shaft 136H and cross shafts 136, it has been found essential to incorporate sliding joint 400 in practical screens so that they can operate without binding.

The recommended procedure to adjust the eccenter shaft assemblies (such as that comprising inboard bearing 121R, outboard bearing 131R, and eccenter bearings 124R and 130R in FIG. 5B) to correct the phase angle error is to set each eccenter shaft (not shown) so that the eccentrics (also not shown) are at top dead center (outer frame) and bottom dead center (inner frame) respectively. This can be done by setting a line scribed on the shaft, to a prick point on the pillow block housing. The prick point mark is located at 12 o'clock on the housing. In the event some of the eccenters are now at 11 or 1 o'clock, they may be brought to 12 o'clock by loosening the SH bushing located in the disk type couplings 134 and rotating their respective shafts 136. With the bushing loose, this can be done without affecting the other eccenters which have correct alignment.

Figure 9A:
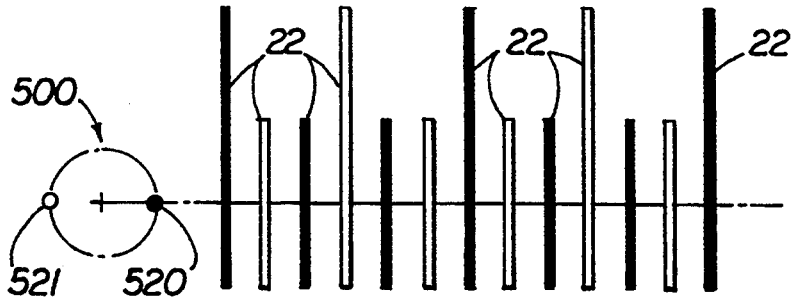
FIGS. 9(A), (B), and (C) are end-view schematic representations of the reciprocating motion of blades in a blade screen.
Figure 9B:
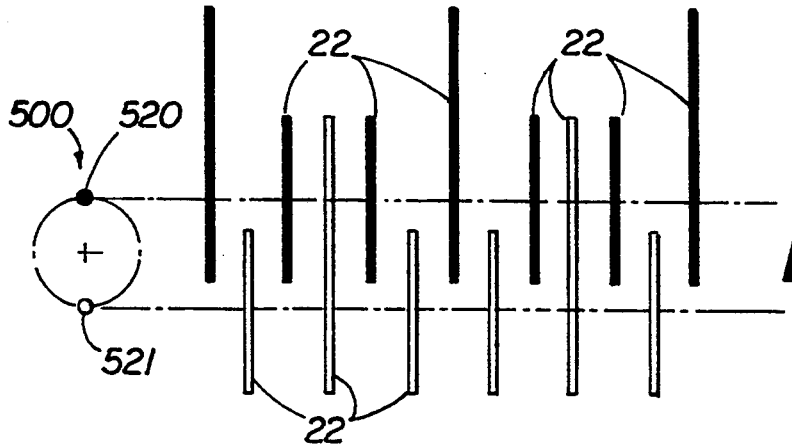
Figure 9C:
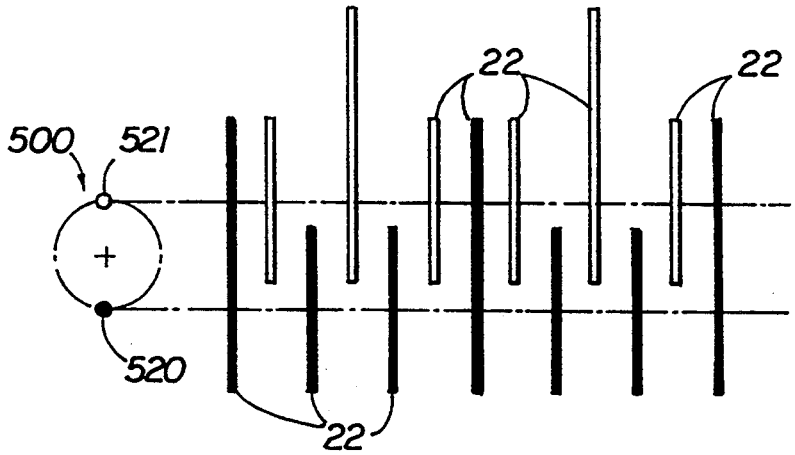

Turning now to FIGS. 9(A), (B), and (C), we observe an end view of the pattern of sets of adjacent blades in the screen. FIGS. 9(A)-(C) show blades 22 mounted on one of the frames, e.g., an inner frame, as thin, unfilled rectangles, while the blades 22 mounted on the other frame, e.g., an outer frame, are shown as solid bars. It will be recognized that which frame is identified as the inner frame and which is identified as outer frame is not important for purposes of this illustration. In a preferred embodiment, two different heights of blades are used. Graph 500 shows the relationship of the frames, as shown by corresponding solid dot 520 and empty dot 521. In FIG. 9(A), the reciprocating motion of eccenters coupled to the frames brings the frames into horizontal alignment, as indicated by graph 500, so that the frames are at equal vertical height. The reciprocating motion of the eccenters is circular and the frames are preferably 180 degrees out of phase, as shown in graph 500. However, horizontal relationships are not shown in the end view of FIGS. 9(A), (B), or (C).

The blades in FIG. 9(A) are arranged in a pattern to further enhance the tilting action of the wood chips passing over and through the sorter. On each frame, there is a repeating pattern of alternating larger blades and smaller blades 22. Preferably, the blades on each frame are arranged so that two smaller blades are between each pair of larger blades 22, and that the larger blades of one frame are between a pair of smaller blades 22 in the other frame. Other patterns are also possible, although tests have revealed that the described pattern is preferable.

Figure 10:
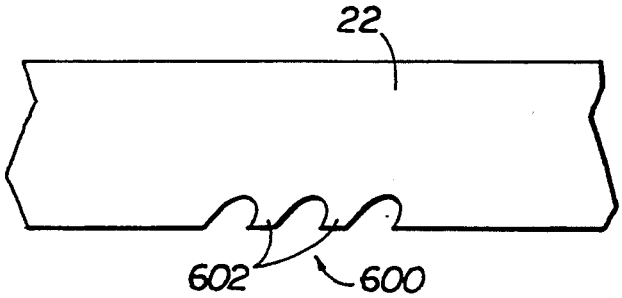
FIG. 10 is a side view of a blade having a sawtooth detail in accordance with the invention.

FIG. 9(B) shows the blades after a 90 degree rotation through the reciprocating action. After another 90 degree rotation, an end view of the blades would again appear as in FIG. 9(A). After yet another 90 degree rotation, the blades will appear, in end view, as shown in FIG. 9(C). The resulting vertical and horizontal motions of blades, together with their alternating sizes and relative placement, enhances the tilting of wood chips placed on the screen formed by the blades, which thereby enhances the sorting process FIG. 10 shows an optional detail of the bottom portion of an end of a typical one of the blades 22. There is a tenancy for a ribbon-like material from the wood chips to build up, especially near the discharge end of the screen. These blades preferably have a sawlike bottom 600 including a plurality of teeth 602 located in the bottom edge of the blade. It has been found that the use of a sawtooth-like bottom 600 helps to avoid the buildup of ribbon-like material from wood chips. It is not necessary that the entire blade bottom 600 have teeth. However, for those blades that are tensioned in the inner frame, it has been found to be particularly effective to have at least a sawtooth portion at the bottom of the blades near the region where those blades extend over the outer frame 102 near the discharge end of the screen. It has also been found to be particularly effective, for those blades that are tensioned in the outer blade assembly, to have at least a sawtooth portion at the bottom of the blades near the region where the blades extend over the inner frame 103 near the discharge end of the screen.

What is claimed is:

1. A blade screen holder comprising:

a bracket;

a leaf spring blade holder stationarily affixed to the bracket and having a first series of alternating shorter and longer slots extending from the bracket, each of the slots in the first series parallel with one another, and each slot adapted to permit a blade to pass therethrough;

means affixed to a first frame member of a blade screen for rotatingly attaching the bracket to a frame, permitting the bracket to pivot about an axis perpendicular to the slots in the leaf spring blade holder;

means affixed to a second frame member opposing the first frame member for removably engaging blades in the blade screen therein;

means fixedly attached to a blade for engaging the blade with the leaf spring blade holder when tension is applied by the leaf spring blade holder, the bracket is rotatingly attached to the frame, and the blade is engaged in the engagement means affixed to the second frame member; and means disposed across the pivoting axis from the leaf spring blade holder that may be adjustably tightened for providing the applied tension to the blade.

2. The blade screen holder of claim 1 further comprising a reinforcing comb stationarily affixed between the bracket and the leaf spring blade holder, the reinforcing comb having a series of longer and shorter slots, and the longer and shorter slots of the reinforcing comb are each aligned with corresponding longer and shorter slots of the leaf spring blade holder, so that blades may pass through respective aligned pairs of slots.

3. The blade screen holder of claim 2 wherein the leaf spring blade holder includes an approximately 45 degree bend in a portion of a leaf spring extending from the bracket, and the reinforcing comb extends from the bracket behind the leaf spring approximately up to the 45 degree bend.

4. The blade screen holder of claim 2 wherein the means fixedly attached to a blade for engaging the blade with the leaf spring blade holder comprises a press-fit snap fitted into a hole in a blade.

5. The blade screen holder of claim 2 wherein the means for applying the tension to the blade comprises an elastic stop nut on a stud, and the position of the elastic stop nut is maintained by a set of spherical washers between the elastic stop nut and the bracket.

6. A screen assembly for a wood chip sorter, comprising:

an inner frame;

an outer frame disposed around and in essentially the same horizontal plane as the inner frame;

a set of rectangular, flat, spaced-apart parallel elongate blades, each engaged on one of the frames, the flat surfaces of the blades disposed in an essentially vertical plane, at least a portion of a bottom edge of each of the blades extending over a top of a frame;

means for moving the inner and outer frames in reciprocating relative movement; and wherein at least a portion of the bottom edges of the blades are provided with sawtooth-like teeth.

* * * * *